US005339295A

United States Patent [19]

Hiromori

[11] Patent Number: 5,339,295

[45] Date of Patent: Aug. 16, 1994

[54] TIMER

[75] Inventor: Junji Hiromori, Tokyo, Japan

[73] Assignee: Hiromori Inc., Tokyo, Japan

[21] Appl. No.: 110,550

[22] Filed: Aug. 23, 1993

[30] Foreign Application Priority Data

Sep. 9, 1992 [JP] Japan ..... 4-69445[U]

[51] Int. Cl.[5] ..... G04F 8/00; G04B 19/00

[52] U.S. Cl. ..... 368/108; 368/223; 368/276

[58] Field of Search ..... 368/72-74, 368/107-113, 250, 251, 276, 69, 70

[56] References Cited

U.S. PATENT DOCUMENTS 4,702,614 10/1987 Copley et al. ..... 368/72

4,888,748 12/1989 Lagasse et al. ..... 368/107

*Primary Examiner*—Vit W. Miska

*Attorney, Agent, or Firm*—Dilworth & Barrese

[57] ABSTRACT

A hollow main body(1) is constituted by a plurality of square or rectangular side plates(3) with the same pattern connected to each other so as to form a polygonal cube frame and lids(4,4*a*,4*b*) having a configuration corresponding to that of the upper and lower openings of said polygonal cube frame. Two ON-contacts(5,5) in the shape of a stick are mounted at each inner surface of a time setting device(2) containing a spherical conductor(6) displaced within the frame with the reduced and almost the same pattern with that of said frame along with a connecting portion (8). Thus, the timer is constituted in a manner that the side plates of said frame and time setting device are parallel each other. A preliminarily prescribed setting time(9) is indicated on the outer surface of said hollow main body(1).

12 Claims, 12 Drawing Sheets

FIG. 2A
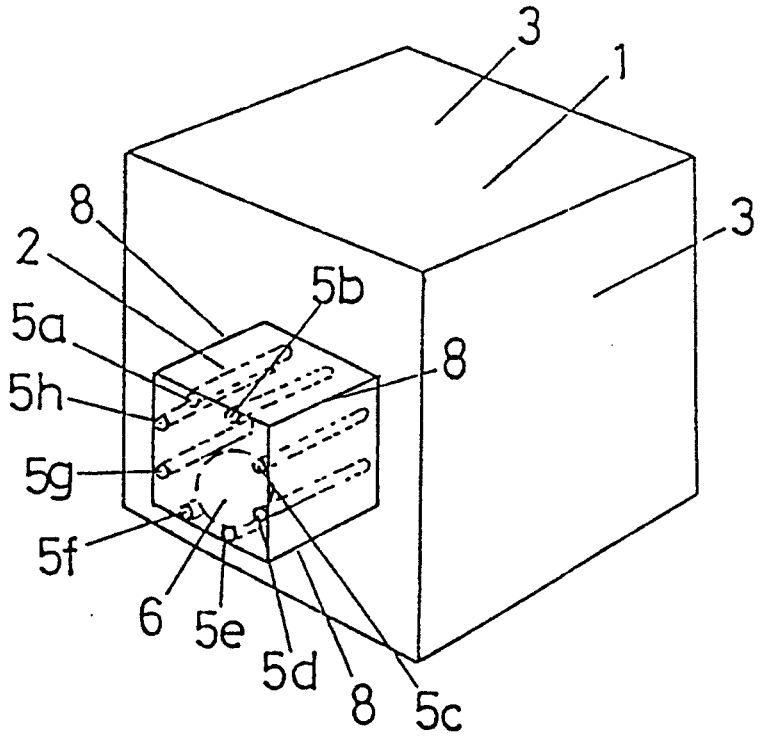
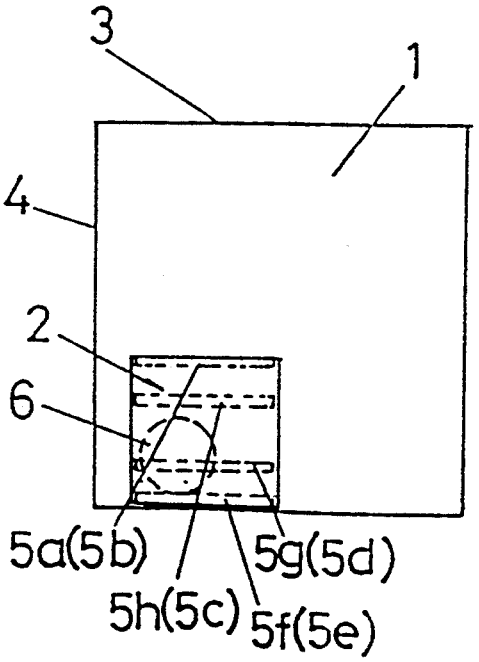
FIG. 2B
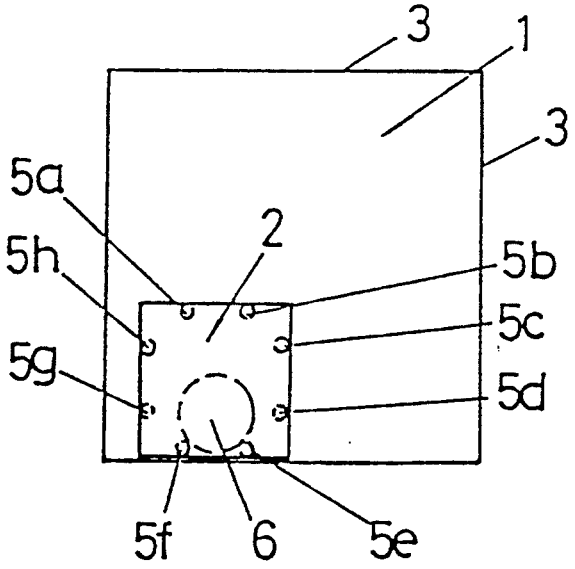
FIG. 2C

FIG. 5A
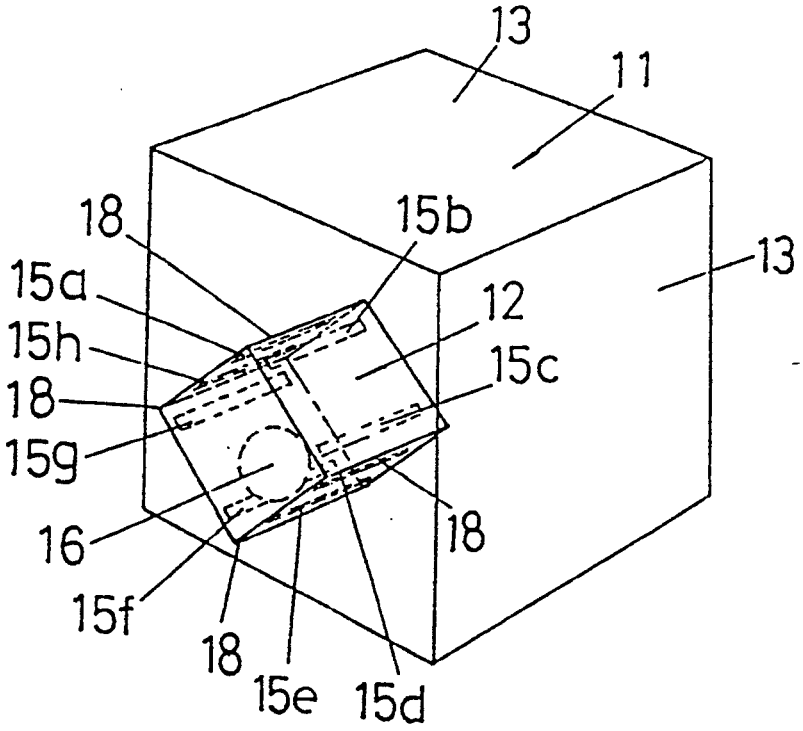
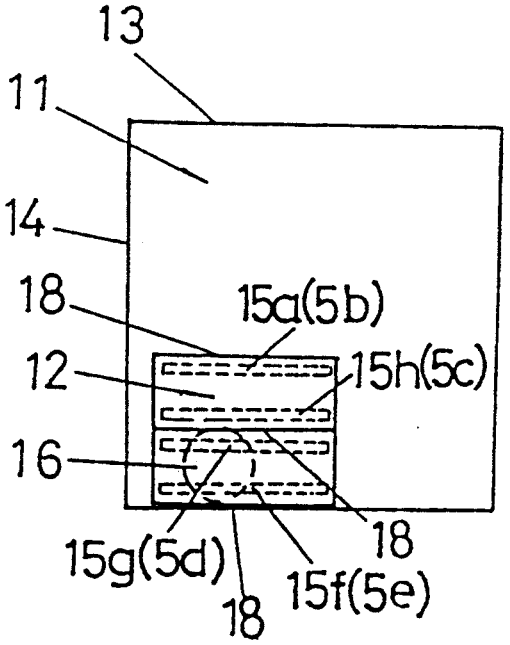
FIG. 5B
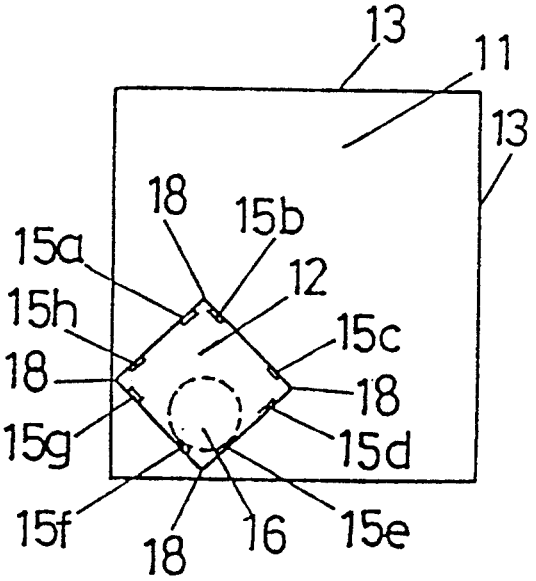
FIG. 5C

FIG. 8A
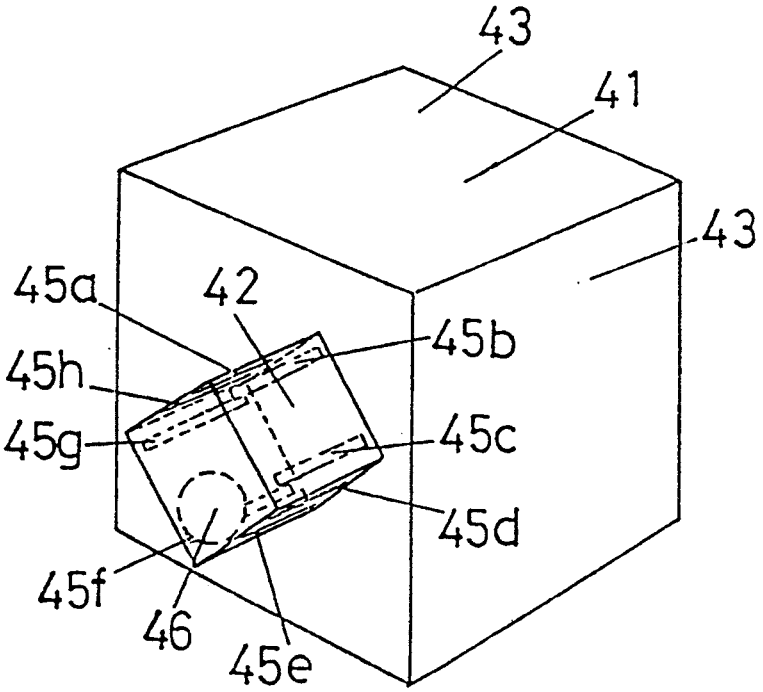
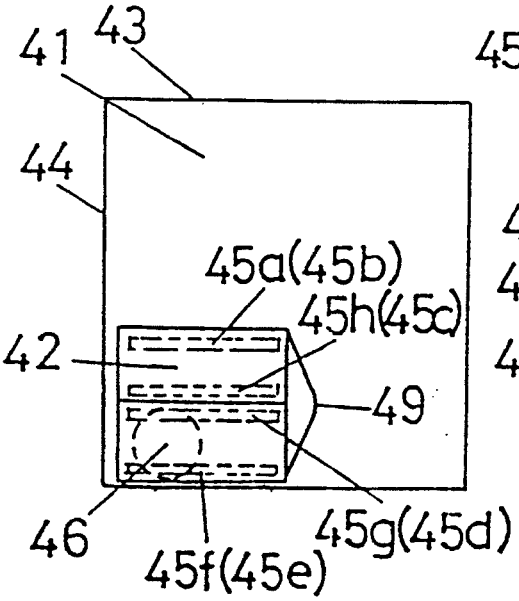
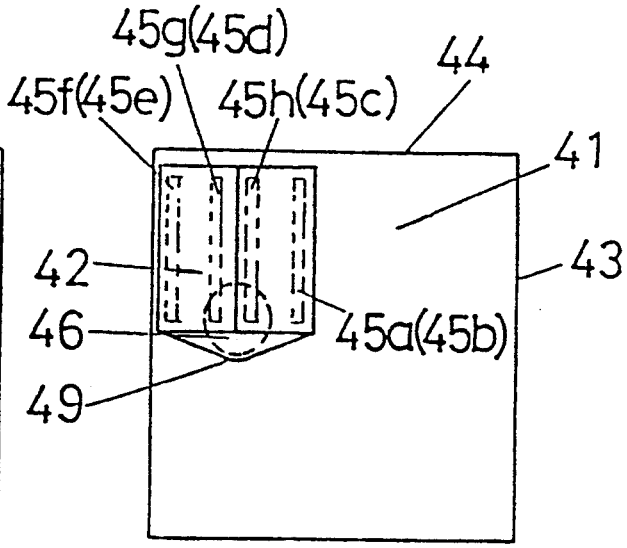
FIG. 8B
FIG. 8C

FIG_9A
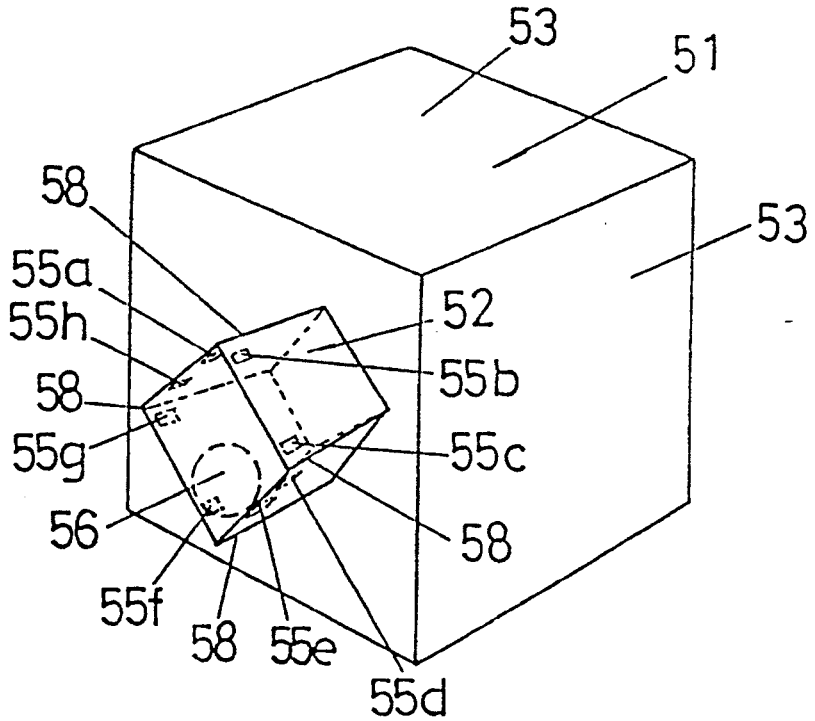
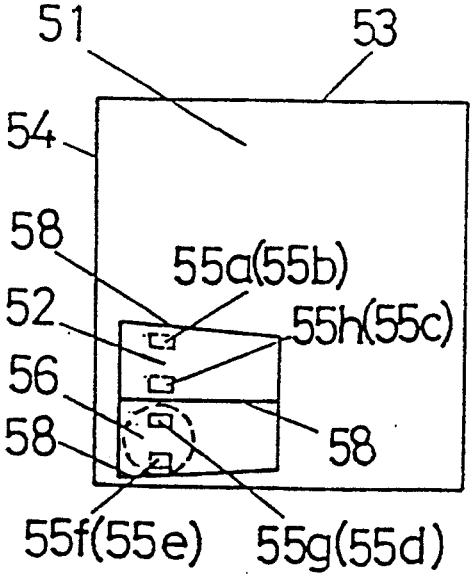
FIG_9B
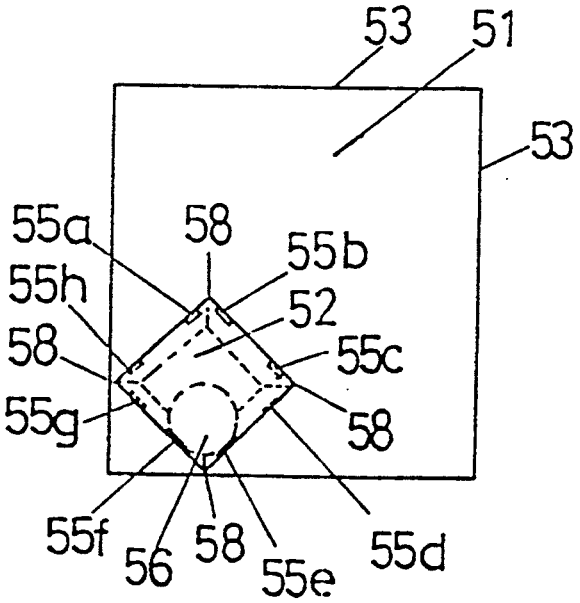
FIG_9C

FIG. 10A
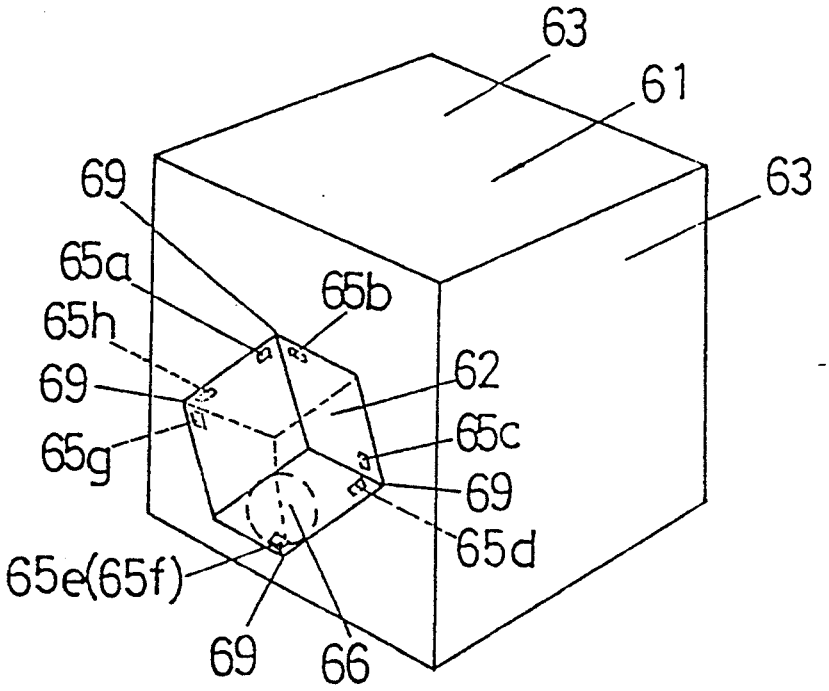
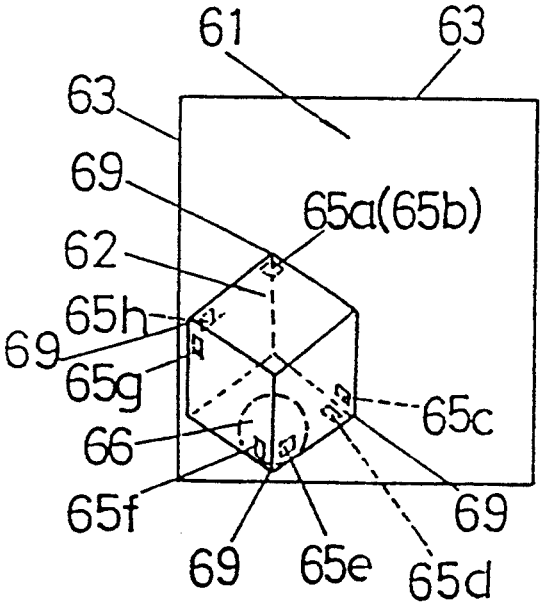
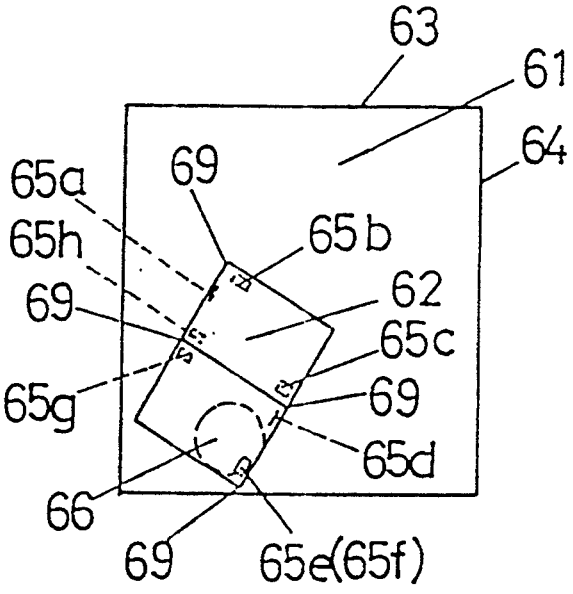
FIG. 10B FIG. 10C

TIMER

BACKGROUND OF THE INVENTION

The present invention relates to a timer for informing of the lapse of a prescribed time by sounding a buzzer etc.

Such a conventional timer for informing of the lapse of a prescribed time by sounding a buzzer etc. when a spring wound up along with setting graduations at the prescribed time returns to its original state or informing of the lapse of a prescribed time by sounding a buzzer etc. when the prescribed time displayed on a digital counter by pushing down a button etc. becomes zero through counting down, was publicly known.

However, according to the aforementioned method of setting a prescribed time by winding a spring, said method falls short of time accuracy and often a considerable degree of an error in time occurs between the prescribed time and the sounding time of the buzzer depending upon a setting manner of graduations. On the other hand, furthermore, according to the method of setting the prescribed time by means of a digital counter, time accuracy itself is sufficient and there occurs almost no error between the prescribed time. However, it is necessary to progress figures in turn which eventually takes time in order to set up the prescribed time. Further, it is sometimes considerably troublesome because even a prescribed time frequently used in everyday life must be set on all such occasions.

SUMMARY OF THE INVENTION

With the above in mind, it is an object of the present invention to provide a timer containing a circuit preliminarily setting a prescribed time, a plurality of ON-contacts for starting the circuit and a buzzer for informing the lapse of the prescribed time by sounding due to the conduction caused by simultaneous touching a spherical conductor with the prescribed two ON-contacts so as to start the circuit.

The aforementioned object can be attained by a timer comprising a plurality of square or rectangular side plates with the same pattern being connected to each other so as to form a polygonal cubic frame, a main hollow body constituted by said cubic frame and further provided with lids corresponding to the upper and lower openings of said cubic frame. Two ON-contacts in the shape of a stick are mounted along with connecting portions of each inner surface of side plates of a time setting device displaced within said main hollow body and further having a reduced and almost the same pattern of a side plate with that of the hollow body. Said time setting device contains a spherical conductor therein being displaced in a manner such that the side plates of said hollow body and that of the time setting device are parallel each other or the side plates of said hollow body and that of said time setting device are shifted 360°/2n (n=the number of an angle of a polygon) from a parallel state through rotation.

By rotating an angle of 360°/2n , the opposing side plates and connecting portions of the main hollow body and time setting device are shifted such that the side plates of the hollow body and the connecting portions of the side plates of the time setting device or the connecting portions of the side plates of the hollow body and the side plates of the time setting device are opposed. Thus, when the timer is brought down in a manner such that an optional side plates of said hollow body may be situated at the base thereof, the connecting portion of the side plate of the time setting device within the hollow body is situated downwards. (Refer to FIGS. 5–7)

Since two ON-contacts are mounted at each inner surface of the side plates of the time setting device, a face of the side plates is situated downwards by bringing the timer down in an optional direction so as to activate the timer from the state of non-use. The spherical conductor situated downwards within the timer setting device is situated onto the inner surface of the side plate pursuant thereto so as to conduct two ON-contacts mounted at the inner surfaces of said side plates through said spherical conductor, thereby sounding the buzzer after the lapse of a prescribed time due to starting the circuit. Furthermore, in the case that the time setting device displaced within the hollow body is fixed thereto by shifting a certain angle through rotation, a face of the side plates of the main hollow body is situated downwards by bringing said hollow body down in the direction such that the opposing face thereto indicating an optional prescribed time may be situated at the top surface of the main hollow body so as to activate the timer from the state of non-use. The spherical conductor situated downwards within the time setting device is situated onto the connecting portion having a configuration of a substantially V-shaped groove, so as to conduct two ON-contacts opposing each other between said connecting portions by means of the spherical conductor, thereby sounding the buzzer after the lapse of a prescribed time due to starting the circuit through said conduction.

BRIEF DESCRIPTION OF THE DRAWINGS

In the Figures:

FIG. 2A is a perspective view to show the structure of said timer; FIG. 2B is a right side perspective view thereof and FIG. 2C is a front perspective view thereof;

FIG. 5A is a perspective view to show another embodiment of the timer according to the present invention; FIG. 5B is a right side perspective view thereof and FIG. 5C is a front perspective view thereof;

FIG. 8A is a perspective view of still another embodiment of the structure of the timer according to the present invention; FIG. 8B is a right side perspective view thereof and FIG. 8C is a right side perspective view of the state of non-use thereof;

FIG. 9A is a perspective view of another embodiment of the structure of the timer according to the present invention; FIG. 9B is a right side perspective view thereof and FIG. 9C is a front perspective view thereof;

FIG. 10A is a perspective view of another embodiment of the structure of the timer according to the present invention; FIG. 10B is a front perspective view thereof and FIG. 10C is a right side perspective view thereof;

DESCRIPTION OF THE PREFERRED EMBODIMENTS

Figure 1:
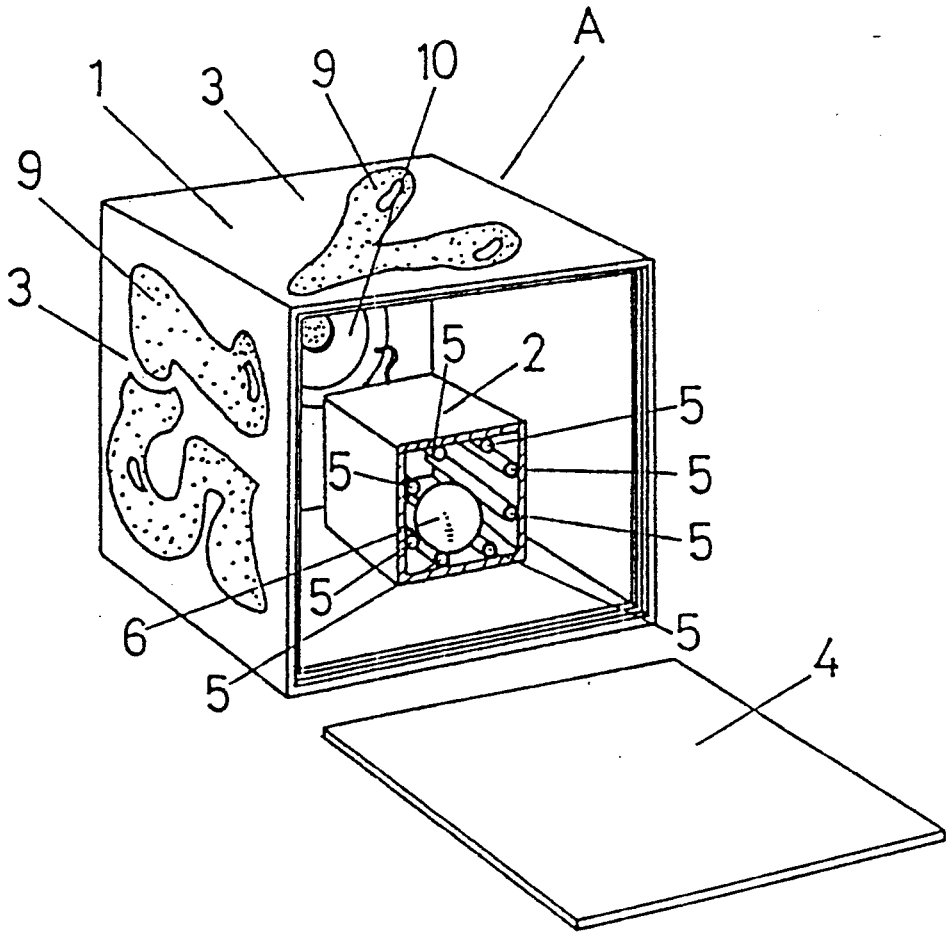
FIG. 1 is a perspective view to show embodiment of use of a timer according to the present invention, wherein a lid is taken out.

Hereinafter, embodiments according to the present invention will be described in detail with reference to the drawings.

As illustrated in FIGS. 1–4, a timer A according to the present invention is constituted as set forth hereinafter.

Square or rectangular side plates 3 with the same pattern, e.g. four plates, are connected to each other to constitute a quadrilateral cube frame. A main hollow body 1 provides with lids 4,4a4b, corresponding to the upper and lower openings of said quadrilateral cube frame. (In FIG. 1, said frame is turned upside down in order to use the timer).

Within said main hollow body 1 , two ON-contacts in the shape of a stick 5a ... 5h along with each connecting portion 8 of the side plates of a time setting device 2 are mounted at each inner surface of said side plates having the reduced and almost the same pattern with that of said main hollow body 1. Said time setting device 2 fixed to the inner surfaces of the side plates of the hollow body 1 and containing a spherical conductor 6, for example a steel ball, is displaced within the main hollow body in a manner that the side plates of said time setting device 2 and that of the main hollow body 1 are parallel each other.

Optional four kinds of a prescribed time which are frequently used everyday life are preliminarily set in the course of the production process of the timer in the case of a quadrilateral cube and a circuit employed is a conventional one for attaining the object of the present invention.

When the timer A is turned upside down in a manner that a face of side plates of the hollow body 1 displaying a prescribed time 9 thereon, for example 7 minutes, is situated to the top surface thereof after turning on a switch 7, the steel ball 6 abuts ON-contacts 5e 5f, thereby starting a circuit(not illustrated) due to the conduction of the ON-contacts 5e 5f. Thus, a buzzer 10 sounds in seven minutes which is an optional prescribed time.

Figure 3:
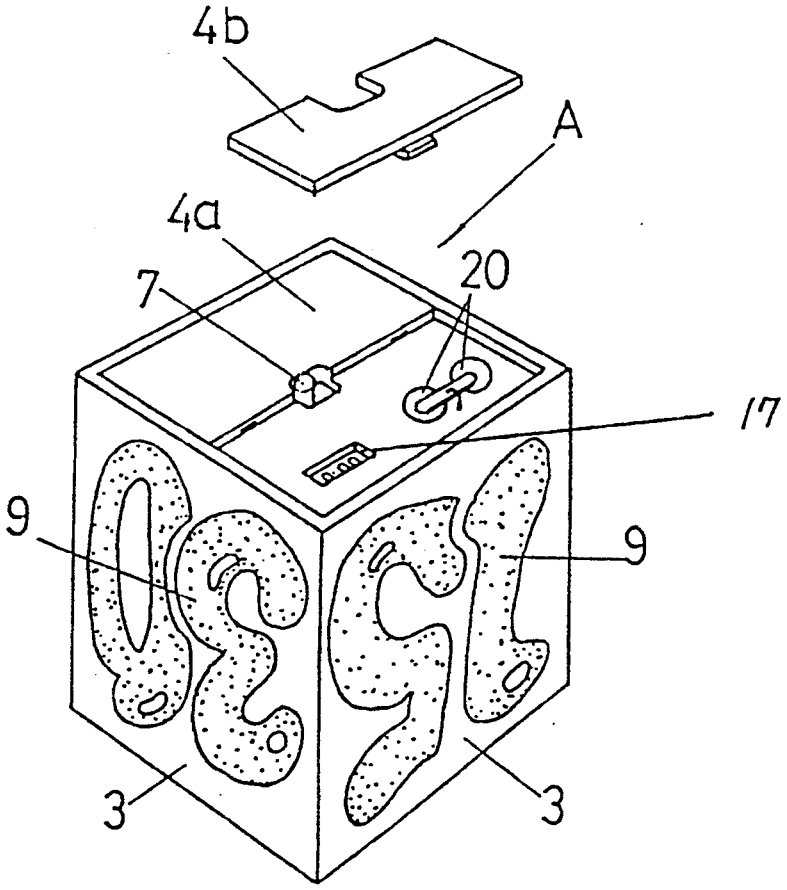
FIG. 3 is a perspective view thereof to show a process for commencing use thereof.
Figure 4:
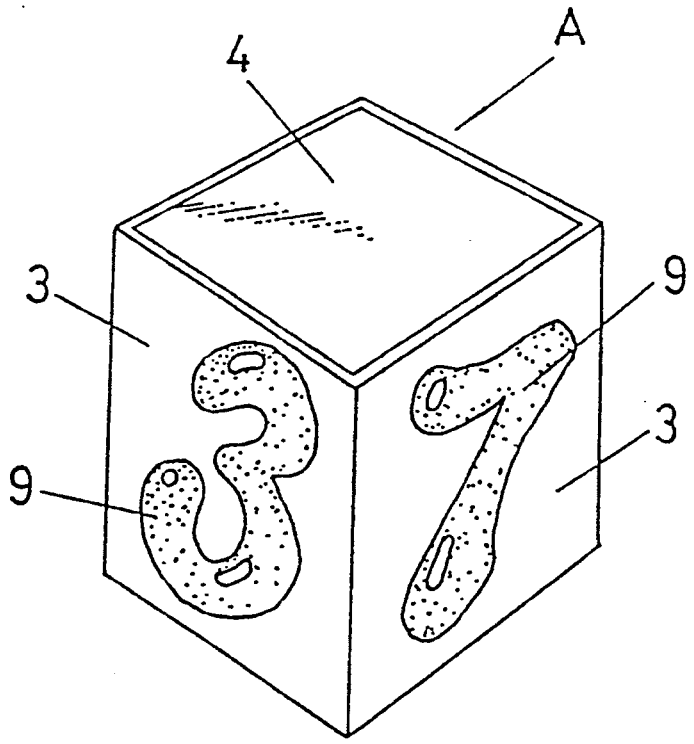
FIG. 4 is a perspective view thereof to show the status of its non-use.

As illustrated in FIG. 1 and FIG. 3, the main hollow body 1 is provided with with lids 4,4a,4b. The switch 7, a battery 20, an indicator 17 for indicating a preliminarily prescribed time and the buzzer 10 are mounted at one of the lids of the main body 1, from which said lids 4a,4b are separable.

FIG. 5 is another embodiment of the timer according to the present invention. As illustrated in FIG. 5, a time setting device 12 fixed to the inner surfaces of the side plates 13 of a main hollow body 11 is displaced in a manner that when the side plates of said hollow body and that of the time setting device are shifted 360°/2n from a parallel state through rotation (n=the number of all angle of a polygon), e.g. 45° in the case of a quadrilateral cube, the connection portions 18,18 of the side plates of the time setting device 12 are situated downwards so as to form a groove in the shape of V substantially, thereby receiving the spherical conductor therein easily and steadily. 15a ... 15h are ON-contacts and 16 is a conductor.

Furthermore, when ON-contacts 5,5 of the time setting device 2 is formed as a coiled conductor (not illustrated), the spherical conductor is put on said ON-contacts. Thus, the coiled conductor can absorb a potential oscillation caused by rolling about of said spherical conductor, thereby always keeping a preferable state of ON-contact.

Figure 6:
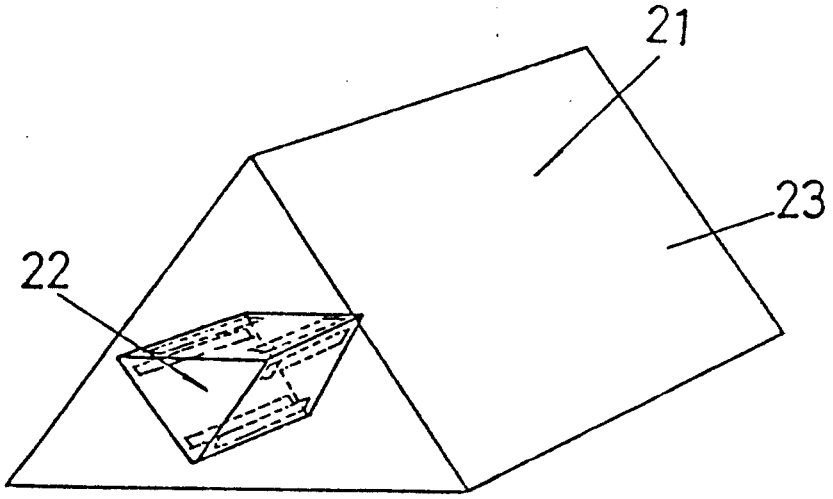
FIG. 6 is a perspective view of still another embodiment of the structure illustrated in FIG. 5.

A timer illustrated in FIG. 6 is constituted in a manner that three square or rectangular side plates 23 with the same pattern are connected to each other to form a main hollow body 21 of a triangular cube, i.e. trigonal prism and further a time setting device 22 is fixed to the inner surfaces of said triangular cube by rotating 60° i.e. shifting 360°/2n (n=the number of an angle of a polygon.

Figure 7:
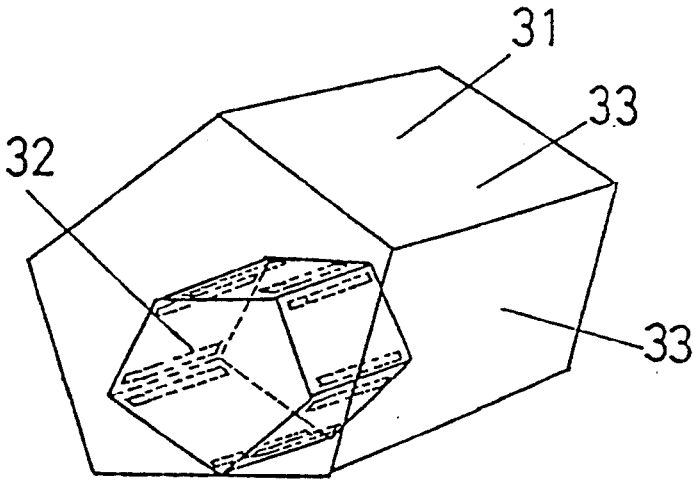
FIG. 7 is a perspective view of still further another embodiment of the structure illustrated in FIG. 5.

A timer illustrated in FIG. 7 is constituted in a manner that five square or rectangular side plates 33 with the same pattern are connected to each other to form a main hollow body 31 of a pentagon cube, i.e. a pentagonal prism and a time setting device 32 is fixed to the inner surfaces of said cube by rotating 36°, i.e. shifting 360°/2n (n=the number of an angle of a polygon).

The above two kinds of the timers are another embodiments of the present invention having the same technical concept as that of the timer illustrated in FIG. 5 and therefore a desired polygonal timer can be obtained.

FIG. 8 is another embodiment of the timer according to the present invention. As illustrated in FIG. 8, when the bottom of a time setting device 42 is formed to have a curved face 49, a spherical conductor 46 is allowed to be receive at said curved face 49 without any fear of contacting the other ON-contacts unnecessarily.

As illustrated in FIG. 9 showing another embodiment of the timer according to the present invention, furthermore, when ON-contacts 55a ... 55h are displaced aside toward either of the lids of the upper and lower openings and further a time setting device 52 is formed to extend in the shape of taper toward the ON-contacts 55a ... 55h, the inclined line of the connecting portion 58 of the side plate of said time setting device 52 toward said ON-contacts is formed. Therefore, there is no fear of releasing the the conduction state due to rolling down of the spherical conductor 56 even if said ON-contacts are not in the shape of a stick.

A timer illustrated in FIG. 10 is constituted in a manner that four square side plates 63 are connected to each other to form a quadrilateral cubic main hollow body 61 and a pair of ON-contacts 65a ... 65h are mounted at the inner surfaces of the side plates of a time setting device 62 having the reduced and almost the same pattern with that of said hollow body 61 and containing a spherical conductor 66 mounted at an opposing position between apexes 69 ... 69 of said side plates of the device 62. Further said time setting device is fixed to the inner surfaces of said hollow body 61 by rotating 360°/2n(n=the number of an angle of a polygon), i.e. 45° in the horizontal and vertical direction from a parallel state. This is another embodiment of the timer according to the present invention.

Figure 11:
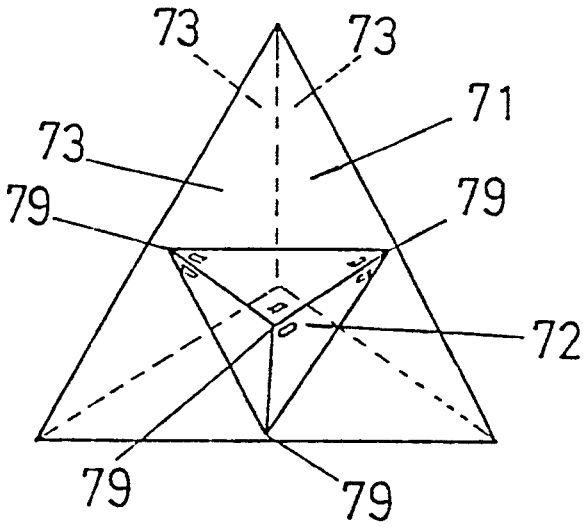
FIG. 11 is a perspective view of another embodiment of the structure of the timer according to the present invention illustrated in FIG. 10.

A timer illustrated in FIG. 11 is constituted in a manner that three regular triangular side plates 73 are connected to each other to form a main hollow body 71 i.e. a regular triangular cube and a time setting device 72 having the reduced and almost the same pattern with that of said main hollow body 71 is fixed to the inner surfaces of said body 71 by rotating 360°/2n(n=the number of an angle of a polygon) i.e. 60° in the horizontal and vertical directions form a parallel state. This is another embodiment of the timer according to the present invention.

Figure 12:
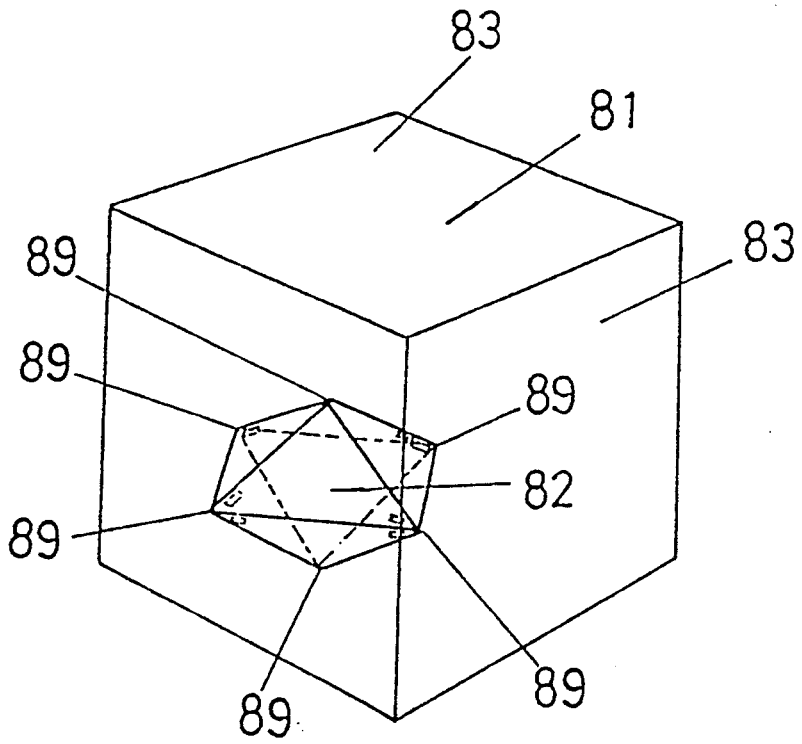
FIG. 12 is a perspective view of another embodiment of the structure of the timer according to the present invention.

A timer illustrated in FIG. 12 is constituted in a manner that square or rectangular side plates 83 are connected to each other to form a main hollow body 81 and a time setting device 82 having the same number of an apex with that of said hollow body 81 and further providing with ON-contacts mounted at each apex of said time setting device is fixed to the inner surfaces of said hollow body 81 so that the apexes of said device 82 oppose to the side plates of said hollow body 81.

Just like the timers illustrated in FIGS. 5–7,11 and 12, this is another embodiment of the timer according to the present invention, wherein the displacements of the time setting device to the hollow body are modified. Therefore, a timer having a desired configuration can be obtained even when the configurations of the hollow body and the time setting device are not the same.

As described above, according to the timer of the present invention, it possible to set a prescribed time quite easily and further is possible to avoid such troublesome difficulty in setting such time which is frequently used in everyday life on all occasions. Since a desired time is preliminarily set by the timer there is no fear of any time error occuring. A configuration of the timer according to the present invention is very attractive in appearance which is worthy of an interior design.

What is claimed is:

1. A timer comprising:

a plurality of square or rectangular side plates, a polygonal cube frame formed by connecting said plurality of square or rectangular side plates to each other, a main hollow body (1) constituted by said polygonal cube frame and lids (4, 4*a*, 4*b*) with the configuration corresponding to that of the upper and lower openings of said polygonal cube frame, a time setting device (2) containing side plates, a spherical conductor (6) and further provided with two ON-contacts (5, 5) in the shape of a stick mounted at each inner surface of the side plates of said device (2) having a reduced and almost the same pattern as that of said main hollow body, and said time setting device (2) being fixed to the main hollow body (1) within said body in a manner such that the side plates of said device (2) and main hollow body (1) are parallel.

2. A timer comprising:

a plurality of square or rectangular side plates, a polygonal cube frame formed by connection said plurality of square or rectangular side plates to each other, a main hollow body (1) constituted by said polygonal cube frame and lids (4, 4*a*, 4*b*) with the configuration corresponding to that of the upper and lower openings of said polygonal cube frame.

a time setting device (2) containing side plates, a spherical conductor (6) and further provided with two ON-contacts (5, 5) in the shape of a stick mounted at each inner surface of the side plates of said device (2) having a reduced and almost the same pattern as that of said main hollow body, and said time setting device (2) being fixed to the main hollow body (1) within said body in a manner such that the side plates of the time setting device (2) and main hollow body (1) are shifted 360°/2n (n=the number of an angle of a polygon) from a parallel state thereof through rotation.

3. The timer according to claim 1 or 2, wherein said ON-contacts(5,5) mounted at the time setting device(2) is a conductor in the shape of a coil.

4. The timer according to of claim 1, wherein a lower lid of the time setting device(2) is curved downwards.

5. The timer according to of claim 1, wherein said ON-contacts(5,5) mounted on the time setting device(2) are displaced aside either of said lids of the upper and lower openings of said polygonal cube frame and further said device extends toward said ON-contacts displaced aside in the form of a taper.

6. A timer comprising:

a regular polygonal cubic main hollow body(31) formed by connecting a plurality of regular polygonal side plates(33) with the same pattern to each other, a pair of ON-contacts mounted at each apex formed by side plates of a time setting device(32) having a reduced and almost the same pattern as that of said main body(31) and mounted at a position between connecting portions of the side plates of said time setting device(32) containing a spherical conductor, and the side plates of said main hollow body and time setting device displaced within said hollow body are shifted 360°/2n (n=the number of an angle of a polygon) in the horizontal and vertical directions through rotation.

7. A timer comprising:

a polygonal cubic main hollow body (21) having an optional configuration, a pair of ON-contacts mounted at an inner surface aside each apex of a time setting device (22) containing a spherical conductor at an opposing position between connecting portions of side plates of said time setting device having the same number of faces of side plates and apices of said hollow body (21), and said setting device (22) being mounted within said hollow body in a manner such that an apex of said time setting device may be opposed to an inner surface of a side plate of said hollow body.

8. The timer according to claim 2, wherein a lower lid of the time setting device (2) is curved downwards.

9. The timer according to claim 3, wherein a lower lid of the time setting device (2) is curved downwards.

10. The timer according to claim 2, wherein said ON-contacts (5,5) mounted on the time setting device (2) are displaced aside either of said lids of the upper and lower openings of said polygonal cube frame and further said device extends towards said ON-contacts displaced aside in the form of a taper.

11. The timer according to claim 3, wherein said ON-contacts (5,5) mounted on the time setting device (2) are displaced aside either of said lids of the upper and lower openings of said polygonal cube frame and further said device extends towards said ON-contacts displaced aside in the form of a taper.

12. The timer according to claim 4, wherein said ON-contacts (5,5) mounted on the time setting device (2) are displaced aside either of said lids of the upper and lower openings of said polygonal cube frame and further said device extends towards said ON-contacts displaced aside in the form of a taper.

* * * * *